US009889668B2

(12) United States Patent
Kifuku

(10) Patent No.: US 9,889,668 B2
(45) Date of Patent: Feb. 13, 2018

(54) PRINTING SYSTEM, PRINT CONTROL DEVICE, AND PRINT CONTROL METHOD

(71) Applicant: Seiko Epson Corporation, Tokyo (JP)

(72) Inventor: Tomoharu Kifuku, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 167 days.

(21) Appl. No.: 14/624,855

(22) Filed: Feb. 18, 2015

(65) Prior Publication Data

US 2015/0266298 A1 Sep. 24, 2015

(30) Foreign Application Priority Data

Mar. 20, 2014 (JP) ..... 2014-057688

(51) Int. Cl.
*B41J 2/165* (2006.01)

(52) U.S. Cl.
CPC ..... *B41J 2/16508* (2013.01); *B41J 2/16526* (2013.01); *B41J 2/16585* (2013.01); *B41J 2002/16529* (2013.01); *B41J 2002/16573* (2013.01)

(58) Field of Classification Search
USPC ..... 347/12
See application file for complete search history.

(56) References Cited

U.S. PATENT DOCUMENTS 5,903,288 A * 5/1999 Yamaguchi ..... B41J 2/16526 347/23
6,345,878 B1 * 2/2002 Kanaya ..... B41J 2/16508 347/23
6,709,088 B2 * 3/2004 Hayakawa ..... B41J 2/16508 347/104
7,431,420 B2 * 10/2008 Inoue ..... B41J 2/16585 347/23
7,588,313 B2 * 9/2009 Kawaguchi ..... B41J 29/393 347/23
7,614,723 B2 * 11/2009 Hatayama ..... B41J 2/16517 347/35
8,152,272 B2 * 4/2012 Kawaguchi ..... B41J 2/16526 347/2
8,262,196 B2 * 9/2012 Mitchell ..... B41J 2/16526 347/35

(Continued)

FOREIGN PATENT DOCUMENTS

JP 08-044512 A 2/1996
JP 2004-358791 12/2004

(Continued)

*Primary Examiner* — Matthew Luu
*Assistant Examiner* — Lily Kemathe
(74) *Attorney, Agent, or Firm* — Foley & Lardner LLP

(57) ABSTRACT

A printing system, print control device, and print control method enable non-technical users without specific technical knowledge to appropriately set the flushing conditions of a printer. A host that sends commands to an inkjet printer that prints on a print medium provides a user interface for selecting an operating mode prioritizing the throughput of the printing operation, or a normal operating mode. When the operating mode prioritizing printer throughput is selected using the user interface, the host generates a command setting a condition for flushing the ink nozzles of the inkjet printer, and sends the generated command to the inkjet printer.

20 Claims, 7 Drawing Sheets

(56) References Cited

U.S. PATENT DOCUMENTS 8,287,087 B2 * 10/2012 Sano ..... B41J 2/16526 347/23
8,506,046 B2 * 8/2013 Chandu ..... G06K 15/102 347/35
8,662,635 B2 * 3/2014 Yuda ..... B41J 2/16552 347/35
8,882,227 B2 * 11/2014 Sato ..... B41J 2/16526 347/14
8,905,517 B2 * 12/2014 Chandu ..... G06K 15/102 347/35
8,944,553 B2 * 2/2015 Walker ..... B41J 2/16526 347/14
9,061,518 B2 * 6/2015 Chandu ..... G06K 15/102
2004/0085391 A1 * 5/2004 Kanaya ..... B41J 2/16508 347/35
2004/0189737 A1 * 9/2004 Nakashima ..... B41J 2/16526 347/23
2006/0214979 A1 * 9/2006 Inoue ..... B41J 2/16585 347/22
2006/0290739 A1 * 12/2006 Hatayama ..... B41J 2/16517 347/35
2007/0057983 A1 * 3/2007 Kawaguchi ..... B41J 29/393 347/9
2009/0167813 A1 * 7/2009 Mitchell ..... B41J 2/16526 347/23
2010/0002028 A1 * 1/2010 Kawaguchi ..... B41J 29/393 347/5
2010/0245438 A1 * 9/2010 Furuhata ..... B41J 29/38 347/14
2013/0076813 A1 * 3/2013 Chandu ..... G06K 15/102 347/9
2013/0076820 A1 * 3/2013 Chandu ..... B41J 2/2142 347/14
2013/0286074 A1 * 10/2013 Chandu ..... G06K 15/102 347/15
2014/0139577 A1 * 5/2014 Sato ..... B41J 2/16526 347/12
2014/0139580 A1 * 5/2014 Sato ..... B41J 2/16526 347/14
2014/0152730 A1 * 6/2014 Sato ..... B41J 2/16526 347/14
2014/0204140 A1 * 7/2014 Sudo ..... B41J 2/16526 347/9
2014/0292869 A1 * 10/2014 Mizutani ..... B41J 2/16526 347/14
2015/0231886 A1 * 8/2015 Yamazaki ..... B41J 2/16508 347/35
2015/0266298 A1 * 9/2015 Kifuku ..... B41J 2/16508 347/9

FOREIGN PATENT DOCUMENTS

JP 2005-161615 A 6/2005
JP 2007-136722 6/2007
JP 2009-154297 A 7/2009
JP 2011-189717 A 9/2011

* cited by examiner

PRINTING SYSTEM, PRINT CONTROL DEVICE, AND PRINT CONTROL METHOD

Priority is claimed under 35 U.S.C. § 119 to Japanese Application No. 2014-057688 filed on Mar. 20, 2014, which is hereby incorporated by reference in its entirety.

BACKGROUND

1. Technical Field

The present disclosure relates to a printing system, a print control device, and a print control method.

2. Related Art

Flushing is done in printers that print by ejecting ink from a printhead in order to prevent the viscosity of ink in the ink nozzles from increasing and nozzles clogging as a result of ink viscosity increasing. Flushing is typically done after moving the printhead to a position removed from the conveyance path of the recording medium. Methods of flushing by ejecting ink onto the print medium have also been proposed to reduce the drop in throughput resulting from moving the printhead away from the conveyance path. See, for example, JP-A-2007-136722. The method described in JP-A-2007-136722 flushes the nozzles in an irregular dot pattern so that the ink ejected to the print medium for flushing is not conspicuous.

The amount of ink that is ejected, and the number of ink nozzles that eject ink, can be reduced in order to make the ejected ink unobtrusive when flushing onto the print medium. On the other hand, increasing the amount of ink is a useful way of increasing the effectiveness of the flushing operation. Because the effectiveness of flushing onto the print medium and print quality are incompatible with each other, enabling the user of the printer to set the flushing conditions based on the printing purpose and other factors is desirable.

Except for printer technicians and others with sufficient technical knowledge, typical printer users have little awareness of the flushing operation used in printers. It is therefore difficult for the user to appropriately set the flushing conditions with an understanding of the effect of flushing on print quality.

SUMMARY

A printing system, print control device, and print control method according to at least one embodiment of the invention enable even users without great technical knowledge to appropriately set the flushing conditions of the printer.

One aspect of at least one embodiment of the invention is a printing system including a printing device and a print control device. The printing device includes: a printhead with ink nozzles; a conveyance unit that conveys a print medium; and a control unit that executes a first flushing ejecting ink from ink nozzles of the printhead into an ink receiving part, and a second flushing ejecting ink from ink nozzles of the printhead onto the print medium. The print control device includes an input reception unit that provides a user interface to select a first operating mode or a second operating mode prioritizing printer throughput more than the first operating mode; a command control unit that generates a command specifying a flushing condition of the printing device when an operating mode is selected through the user interface of the input reception unit; and a command transmission unit that transmits the command generated by the command control unit. The control unit of the printing device receives and interprets commands transmitted by the print control device, and sets a flushing condition according to a received command.

Thus comprised, when the user decides and inputs whether or not to prioritize printer throughput, the conditions for flushing on the conveyance path of the print medium are set appropriately to the input. The user can therefore easily and appropriately set the flushing conditions without needing technical knowledge about the effect of flushing and flushing conditions.

In a printing system according to another aspect of the at least one embodiment of invention, the control unit of the printing device can execute the second flushing according to plural conditions having different ink ejection volumes; and the command control unit of the print control device generates a command setting a first condition having a large ink ejection volume as the condition for the second flushing when the second operating mode is set using the user interface of the input reception unit.

Thus comprised, the condition of whether or not to increase the ink ejection volume when flushing on the print medium conveyance path can be set easily and appropriately.

Further preferably in a printing system according to another aspect of at least one embodiment of the invention, the command control unit of the print control device generates a command setting a second condition in which the ink ejection volume is a specific standard value as the condition for the second flushing when the first operating mode is set using the user interface of the input reception unit.

Thus comprised, the condition of whether or not to increase the ink ejection volume when flushing on the print medium conveyance path can be set easily and appropriately.

Further preferably in a printing system according to another aspect of at least one embodiment of the invention, the control unit of the printing device executes the first flushing at a preset flushing interval; and the flushing interval for executing the second flushing using the first condition is set to a longer time than the flushing interval for executing the second flushing using the second condition.

Thus comprised, throughput can be improved by increasing the ink ejection volume when flushing the ink nozzles on the print medium conveyance path.

In a printing system according to another aspect of at least one embodiment of the invention, the first flushing is a flushing operation that moves the printhead to the position of the ink receiving part, and ejects ink from ink nozzles of the printhead into the ink receiving part; and the second flushing is a flushing operation that ejects ink from the ink nozzles of the printhead onto the print medium while the printhead is on the conveyance path of the print medium.

Thus comprised, the user can easily set the conditions for flushing with the printhead on the print medium conveyance path.

Another aspect of the at least one embodiment of invention is a print control device that controls flushing and printing, the print control device having: an input reception unit that provides a user interface to specify selection of a first operating mode or a second operating mode prioritizing throughput of the printing operation more than the first operating mode; a command control unit that generates a command setting a condition for flushing when an operating mode is selected through the user interface of the input reception unit; and a command transmission unit that transmits the command generated by the command control unit.

Thus comprised, when the user decides and inputs whether or not to prioritize printer throughput, the conditions for flushing on the conveyance path of the print medium are set appropriately to the input. The user can therefore easily and appropriately set the flushing conditions without needing technical knowledge about the effect of flushing and flushing conditions.

Another aspect of the at least one embodiment of invention is a print control method that transmits a command and controls flushing and printing, the control method including: providing a user interface to specify selection of a first operating mode or a second operating mode prioritizing throughput of the printing operation more than the first operating mode; generating a command setting a condition for flushing when an operating mode is selected through the user interface; and transmitting the generated command.

Thus comprised, when the user decides and inputs whether or not to prioritize printer throughput, the conditions for flushing on the conveyance path of the print medium are set appropriately to the input. The user can therefore easily and appropriately set the flushing conditions without needing technical knowledge about the effect of flushing and flushing conditions.

Other objects and attainments together with a fuller understanding of the invention will become apparent and appreciated by referring to the following description and claims taken in conjunction with the accompanying drawings.

DESCRIPTION OF EMBODIMENTS

Some embodiments of the present invention are described below with reference to the accompanying figures.

Figure 1:
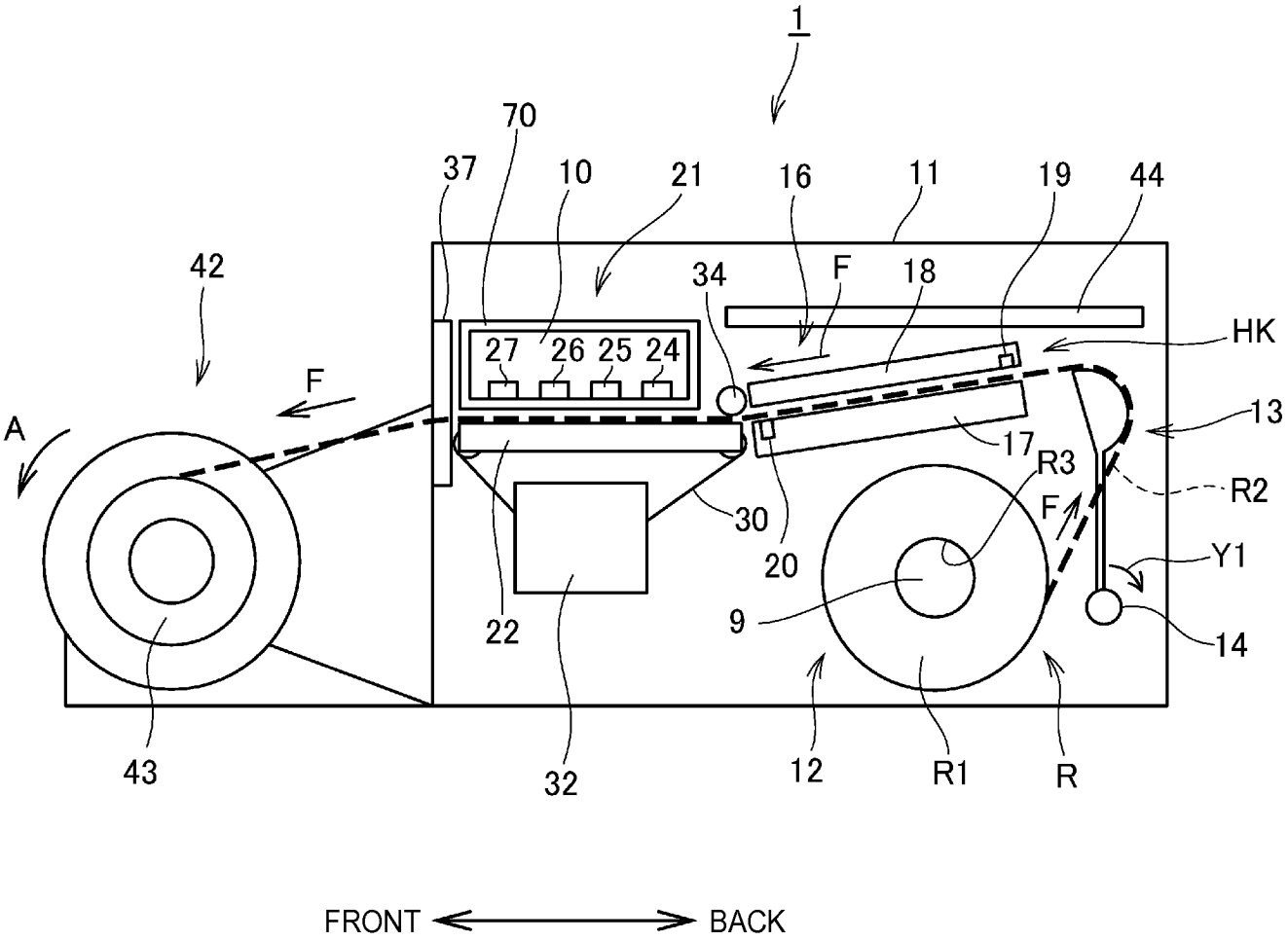
FIG. 1 is a side view of the inside of an inkjet printer according to some inventions.
Figure 2:
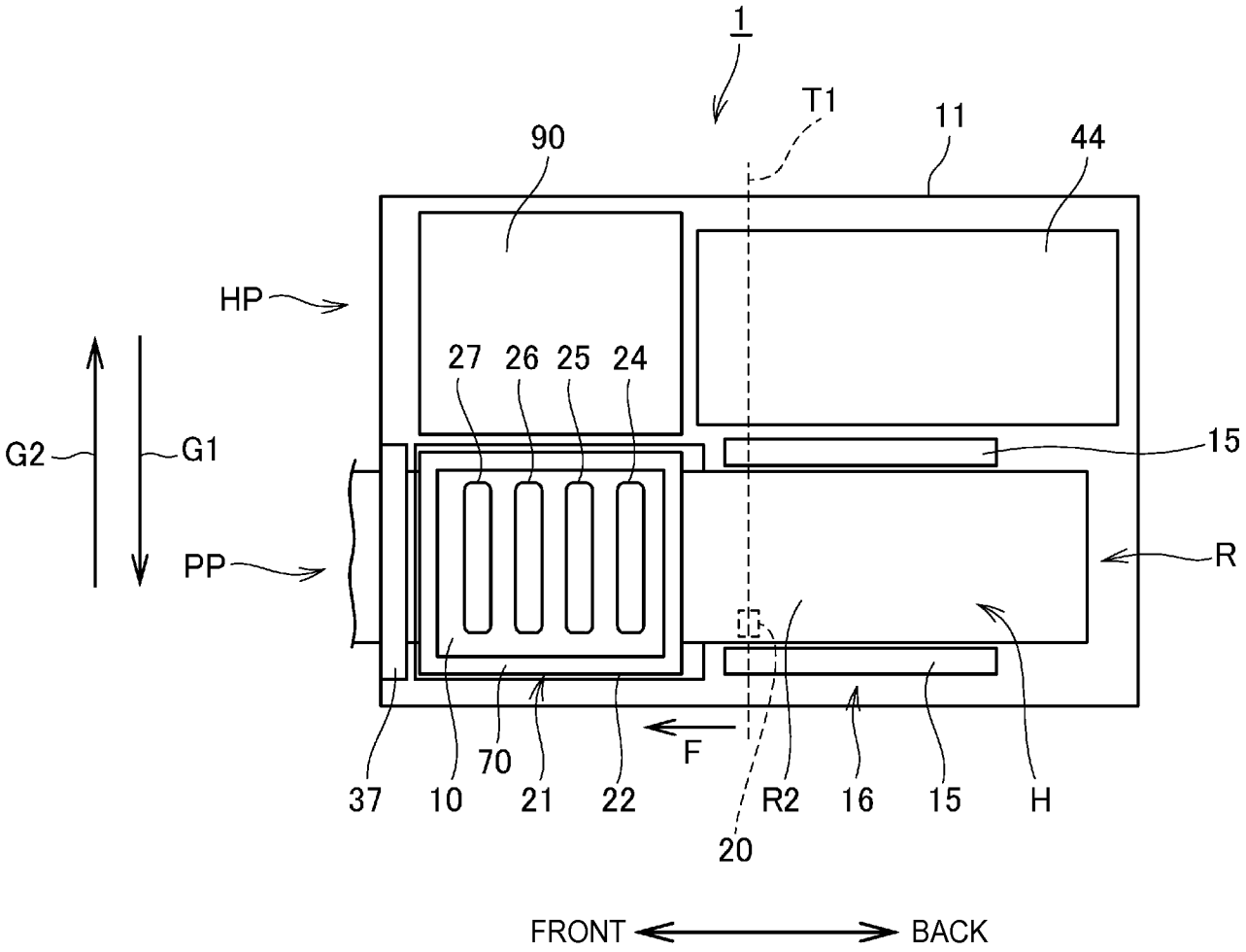
FIG. 2 is a plan view showing the inside configuration of the inkjet printer.

FIG. 1 is a side view schematically illustrating the internal configuration of an inkjet printer 1 (printing device) in a printing system 2 according to some embodiments of the present invention. FIG. 2 is a plan view illustrating the internal construction of the inkjet printer 1.

The inkjet printer 1 in this embodiment is a line inkjet printer, and prints images on a recording medium (print medium) by ejecting ink from an inkjet line head 10 (printhead) while conveying the recording medium through a conveyance path HK.

In the following description of the printer using FIG. 1 and FIG. 2, the longitudinal axis between the front and back of the printer is indicated by the arrows in the figures.

As shown in FIG. 1, the inkjet printer 1 has a printer case 11, and a roll paper storage compartment 12 is formed inside the back of the printer case 11.

Roll paper R is held as the recording medium (print medium) inside the roll paper storage compartment 12. The paper roll R is a continuous sheet medium wound into a roll, and may be plain paper or fine paper wound into a roll, or label paper having labels of a regular size and an adhesive backing applied to a release liner (web) and wound into a roll.

Below, the portion of the paper roll R that forms a roll with a hollow center is referred to as the paper roll R1, and the paper that is pulled from the paper roll R1 and conveyed through the conveyance path HK is referred to as the conveyed roll paper R2. The conveyed roll paper R2 is indicated in FIG. 1 by a dotted line.

The paper roll R1 is stored in the roll paper storage compartment 12. At this time, a roll paper spindle 9 is inserted to the hollow core R3 formed in the center of the paper roll R1. The roll paper spindle 9 is connected through a speed reducer mechanism not shown to the motor shaft of a spindle rotation motor 64 described below. The paper roll R1 turns in conjunction with rotation of the roll paper spindle 9 fit into the core R3 of the paper roll R1.

The conveyed roll paper R2 is pulled from the paper roll R1 in the roll paper storage compartment 12 upward and then forward in the conveyance direction F. A tension lever 13 is disposed behind the axis of the paper roll R1. The conveyed roll paper R2 pulled upward contacts the tension lever 13, curves around the tension lever 13, and then continues to the front.

The tension lever 13 applies tension to the conveyed roll paper R2 and prevents slack. The tension lever 13 is urged to pivot on a pin 14 in the direction applying tension to the conveyed roll paper R2 (the direction indicated by arrow Y1).

A paper guide 16 is disposed in front of the tension lever 13. The paper guide 16 includes a lower paper guide 17 (FIG. 1), upper paper guide 18 (FIG. 1), and side paper guide 15 (FIG. 2). The lower paper guide 17 is a platform that supports the conveyed roll paper R2 from below. The upper paper guide 18 is positioned opposite the lower paper guide 17 with the conveyed roll paper R2 therebetween, and prevents the conveyed roll paper R2 from lifting away from the lower paper guide 17. The side paper guide 15 guides the sides of the conveyed roll paper R2 in the conveyance direction F, and suppresses the conveyed roll paper R2 from skewing and shifting.

A paper detector 19 (FIG. 1) is disposed at the back end of the paper guide 16. The paper detector 19 is a transmissive optical sensor including an emitter on the upper paper guide 18 side and a photoreceptor on the lower paper guide 17 side. A detection value indicating the amount of light received by the photoreceptor of the paper detector 19 is output to a printer control unit 50 described below. The detection value from the paper detector 19 differs according to whether or not there is conveyed roll paper R2 at the position of the paper detector 19. Based on the detection value from the paper detector 19, the printer control unit 50 detects when the leading end of the conveyed roll paper R2 reaches the position where the paper detector 19 is disposed, and when the trailing end of the conveyed roll paper R2 reaches the paper detector 19.

A black mark detector 20 is disposed at the front end of the paper guide 16. The black mark detector 20 is a reflective optical sensor including an emitter that emits light to the back side of the conveyed roll paper R2, and a photoreceptor that receives the reflection of light emitted by the emitter. The black mark detector 20 is used to detect when a black mark BM described below reaches the detection position T1 (see FIG. 2) of the black mark detector 20. More specifically, a detection value indicating the amount of light received by the photoreceptor of the black mark detector 20 is output to the printer control unit 50. The detection value from the black mark detector 20 differs according to whether or not a black mark BM is at the detection position T1. Based on the detection value from the black mark detector 20, the printer control unit 50 detects if a black mark BM has reached the detection position T1.

A print unit 21 that prints images on the conveyed roll paper R2 is disposed at the front of the paper guide 16. The print unit 21 includes a platen 22 and the inkjet head 10.

The inkjet head 10 in this embodiment ejects four colors of ink, C (cyan), M (magenta), Y (yellow), K (black), and forms dots on the printing surface of the conveyed roll paper R2. The inkjet head 10 includes a black head unit 24 that ejects black ink, a cyan head unit 25 that ejects cyan ink, a magenta head unit 26 that ejects magenta ink, and a yellow head unit 27 that ejects yellow ink.

The platen 22 has a flat surface located along the conveyance direction F. This flat surface is opposite the inkjet head 10. The platen 22 is fixed to the frame of the inkjet printer 1, and supports the conveyed roll paper R2 from below.

A conveyor belt 30 (FIG. 1) is disposed over the surface of the platen 22. The conveyor belt 30 is a wide, endless belt that travels over the top of the platen 22 and then loops around the bottom of the platen 22. At least the surface of the conveyor belt 30 that faces up when traveling over the top of the platen 22 is a rough surface with a high coefficient of friction. The conveyor belt 30 is further preferably made of rubber or plastic elastic material. A conveyance unit 32 including a conveyance motor 31 (FIG. 4) and a drive mechanism that moves the conveyor belt 30 by means of the torque from the conveyance motor 31 is disposed below the platen 22. The drive mechanism of this conveyance unit 32 includes a gear that engages the output shaft of the conveyance motor 31, and a roller that moves the conveyor belt 30. The conveyor belt 30 moves according to rotation of the conveyance motor 31, and conveys the conveyed roll paper R2 in the conveyance direction F.

A conveyance roller 34 (FIG. 1) is disposed opposite the platen 22 on the upstream side of the inkjet head 10 on the conveyance path HK. The conveyance roller 34 is a driven roller supported freely rotatably on the frame of the inkjet printer 1, and is urged toward the surface of the platen 22. On the conveyance path HK, the conveyed roll paper R2 is held between the conveyance roller 34 and the conveyor belt 30, and is conveyed in the conveyance direction F in conjunction with movement of the conveyor belt 30. Multiple rollers not shown are also disposed between the head units of the inkjet head 10 to push down on and prevent the conveyed roll paper R2 from lifting away from the surface of the conveyor belt 30.

Figure 4:
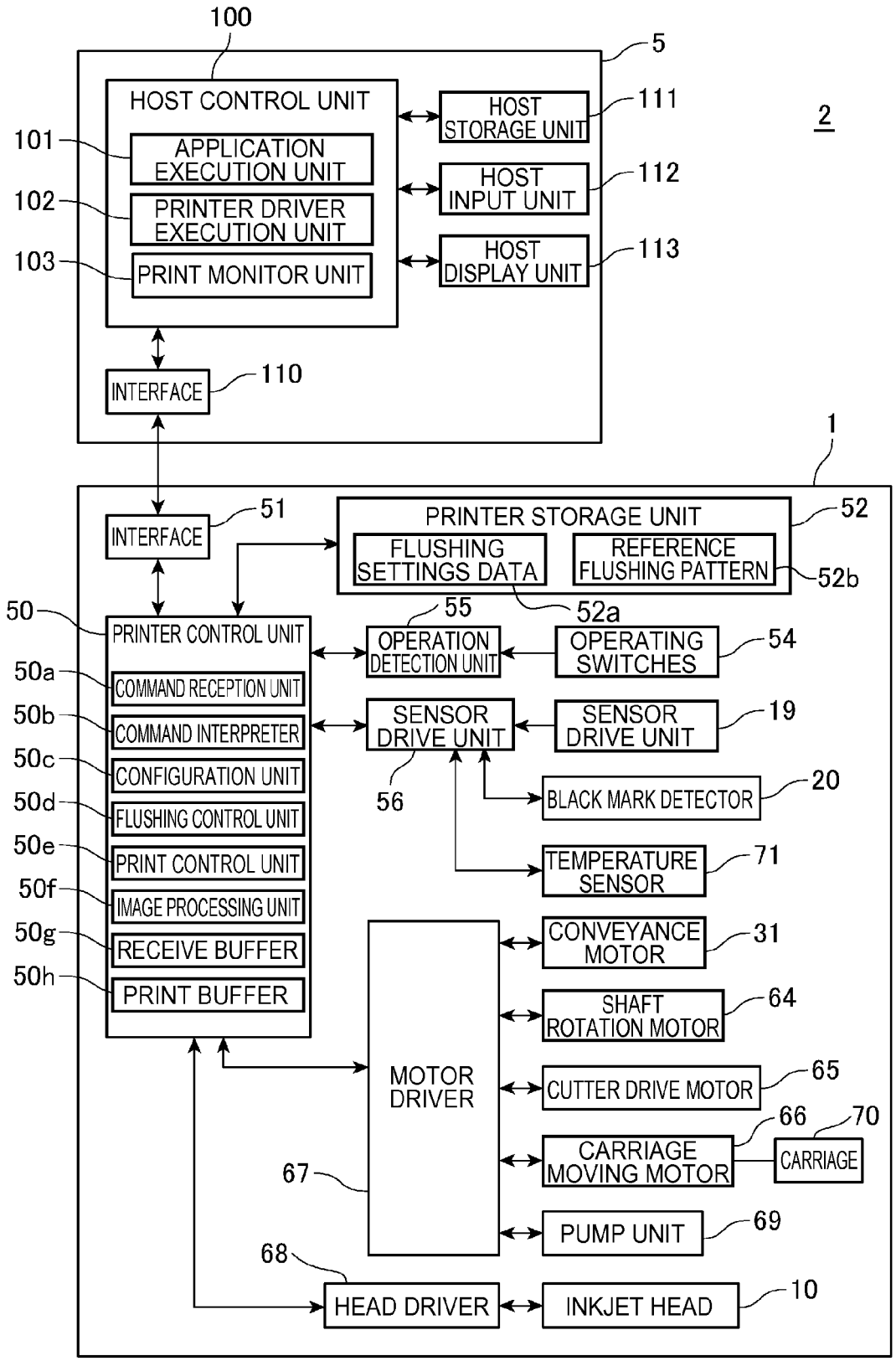
FIG. 4 is a block diagram illustrating the functional configuration of a printing system.

A cutter unit 37 is disposed on the downstream side of the inkjet head 10 on the conveyance path HK. The cutter unit 37 includes a fixed knife and a movable knife on opposite sides of he conveyance path HK, and the movable knife is linked through a gear, for example, to the cutter drive motor 65 (FIG. 4). When the cutter drive motor 65 turns, the movable knife moves to the fixed knife side and cuts the conveyed roll paper R2 therebetween. The cutter unit 37 may make a partial cut leaving the conveyed roll paper R2 uncut in part across the width, or it may cut the conveyed roll paper R2 completely.

A winding unit 42 (FIG. 1) is removably connected to the front of the inkjet printer 1. Note that the winding unit 42 is omitted from FIG. 2. The winding unit 42 includes a take-up drum 43 onto which the conveyed roll paper R2 discharged from the paper exit is wound, and a drive unit not shown that turns the take-up drum 43. The take-up drum 43 is driven by torque from the conveyance motor 31 of the inkjet printer 1 transferred through a gear train not shown. The take-up drum 43 may be configured to be driven by a motor separate from the conveyance motor 31. The take-up drum 43 turns in the direction indicated by arrow A in the figure, and rewinds the conveyed roll paper R2. When the winding unit 42 is used, the inkjet printer 1 does not cut the conveyed roll paper R2 with the cutter unit 37, and the conveyed roll paper R2 is discharged from the paper exit as a continuous web.

A control board 44 is disposed toward the front on the right side of the paper guide 16. The CPU, RAM, and other peripheral circuits of the printer control unit 50 are disposed to the control board 44.

As shown in FIG. 1 and FIG. 2, the inkjet head 10 is mounted on a carriage 70. As shown in FIG. 2, the carriage 70 can move in a main scanning direction G1 and a reverse scanning direction G2, and moves the inkjet head 10 between a printing position PP and a home position HP as shown in FIG. 2. The printer control unit 50 (FIG. 4) drives the carriage moving motor 66 to move the carriage 70.

The printing position PP is a position opposite the platen 22, and is the position where ink is ejected to the conveyed roll paper R2 to print an image on the printing surface. To print an image, the inkjet head 10 is moved down by a specific mechanism and set to an appropriate position at the printing position PP.

The home position HP is the retracted position of the inkjet head 10 disposed to a position away from the above printing position PP. A maintenance unit 90 (ink receiver part) having a cap (not shown in the figure) that covers the nozzle face of the inkjet head 10 is disposed to the home position HP. The maintenance unit 90 includes a drive unit (not shown in the figure) that moves the cap vertically to and away from the nozzle face, and seals the nozzle face of the inkjet head 10 set to the home position HP with the cap. The maintenance unit 90 also includes a pump unit 69 (FIG. 4) that reduces the pressure inside the cap and suctions ink from the nozzles of the inkjet head 10, and a waste ink tank (not shown in the figure) for holding the ink suctioned by the pump unit 69.

The printer control unit 50 described below moves the carriage 70 and sets the inkjet head 10 to the home position HP when a specific event occurs, such as when the power is turned off, or when a printing process is not executed for a specific time and the standby mode is entered. The printer control unit 50 then covers the nozzle face of the inkjet head 10 with the cap of the maintenance unit 90. As a result, the ink left in the nozzles drying and the viscosity increasing can be suppressed.

Flushing and cleaning processes are also performed at the home position HP.

In the flushing operation, the printer control unit 50 seals the nozzle face with the cap of the maintenance unit 90, then ejects a specific amount of ink a specific number of times from the nozzles into the cap, replacing the ink left inside the nozzles with fresh ink. In the cleaning process, the printer control unit 50 seals the nozzle face with the cap of the maintenance unit 90, drives the pump unit 69, and suctions the ink from inside the nozzles.

Flushing with the inkjet head 10 set to the home position HP is referred to herein as regular flushing (first flushing). Regular flushing is executed whenever the time that the printing operation continues without interruption reaches a preset flushing interval (flushing time). In this event, the printer control unit 50 stops conveyance of the conveyed roll paper R2, moves the inkjet head 10 to the home position HP, and ejects ink from the nozzles into the maintenance unit 90. The printer control unit 50 then returns the inkjet head 10 to the printing position PP, starts conveying the conveyed roll paper R2, and resumes printing.

The printer control unit 50 can also flush the nozzles while the inkjet head 10 remains at the printing position PP, that is, remains positioned above the conveyed roll paper R2. This flushing operation is called onto-paper flushing (second flushing). Onto-paper flushing forms dots unrelated to the image being printed while printing an image (which may be text or a picture) with the inkjet head 10. This can prevent the ink viscosity from increasing in nozzles that are not used for a long time.

With onto-paper flushing, ink is discharged to the conveyed roll paper R2 in areas where an image is not printed. As a result, if the amount of ink ejected in onto-paper flushing is great, the ink ejected for flushing may appear as random ink spray and adversely affect print quality. The inkjet printer 1 can therefore set the amount of ink ejected for onto-paper flushing to any of multiple levels. For simplicity, this embodiment can set the amount of ink to one of two levels, level 1 or level 2, where the amount of ink ejected in level 1 (first flushing condition) is great, and the amount of ink at level 2 (second flushing condition) is less than level 1. For example, the number of dots and/or the size of dots (the amount of ink per dot) that are formed by onto-paper flushing separately to the dots formed for the image being printed may differ in level 1 and level 2.

The printer control unit 50 performs both regular flushing and onto-paper flushing during the printing operation. The printer control unit 50 performs regular flushing at a specific flushing interval, which is a preset time, and performs onto-paper flushing between regular flushing operations. When the level for onto-paper flushing is set to level 1, which is the level ejecting the greatest amount of ink, increased ink viscosity can be prevented in more nozzles, and the frequency of regular flushing can therefore be reduced. The printer control unit 50 therefore performs regular flushing at different flushing intervals when onto-paper flushing is set to level 1 and level 2.

When onto-paper flushing is set to level 1, the flushing interval is set to a longer time than when set to level 2. The frequency of regular flushing can therefore be minimized according to the level of onto-paper flushing, and a drop in throughput can be prevented.

Figure 3:
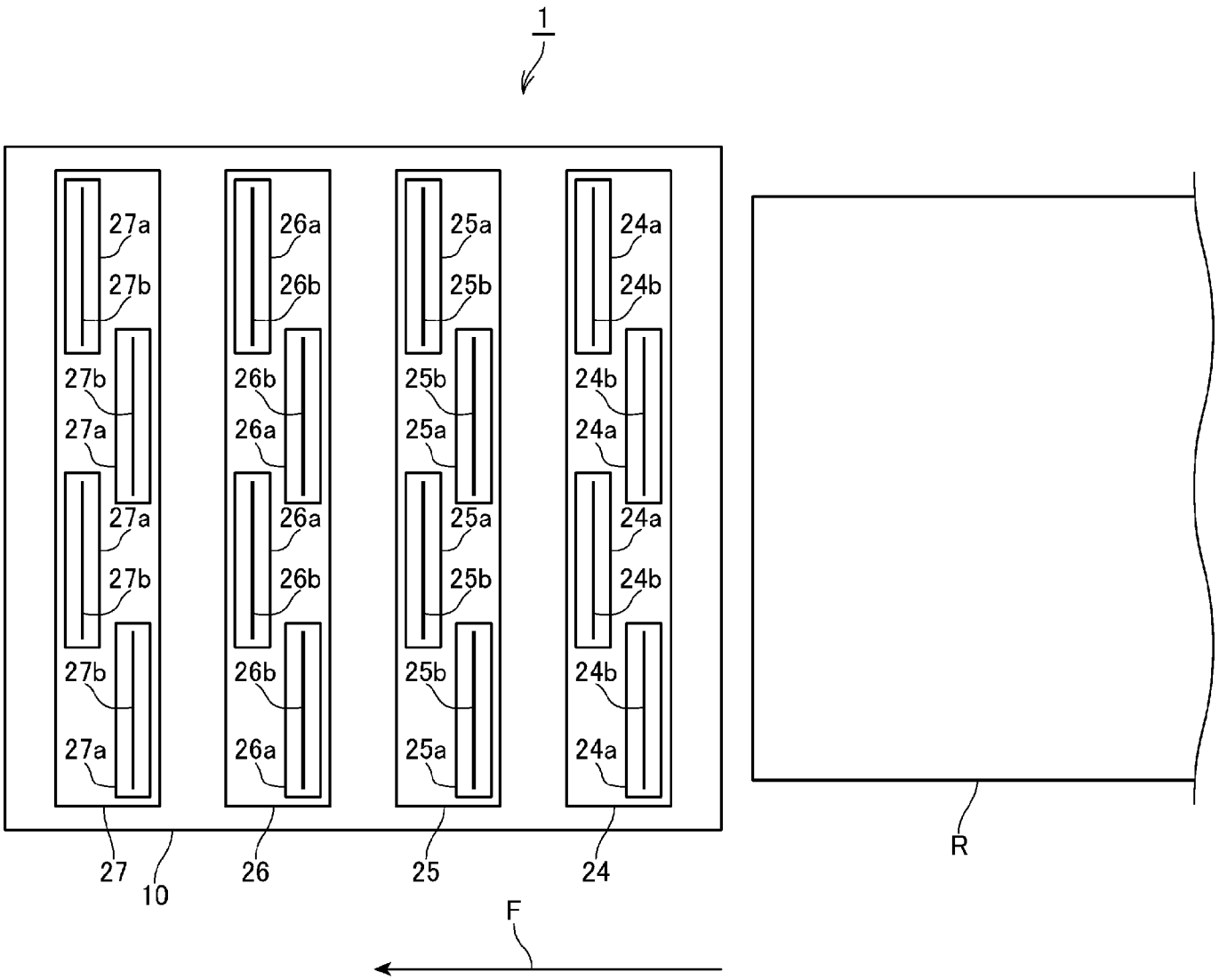
FIG. 3 illustrates the configuration of the inkjet head.

FIG. 3 shows the configuration of the inkjet head 10 of the inkjet printer 1 in detail.

The inkjet head 10 has a black head unit 24, cyan head unit 25, magenta head unit 26, and yellow head unit 27. The head units are arranged in the inkjet head 10 in the order black head unit 24, cyan head unit 25, magenta head unit 26, and yellow head unit 27 in the conveyance direction F.

The four black heads 24*a* in the black head unit 24 are staggered to each other. A black nozzle row 24*b* is formed in each of the black heads 24*a*. The black nozzle row 24*b* is a row of nozzles (not shown in the figure) that eject ink as fine ink droplets formed in a line crosswise to the conveyance direction F. Ink from a black ink cartridge is supplied to the black heads 24*a*.

The black heads 24*a* push black ink toward the conveyed roll paper R2, and eject fine ink droplets from specific nozzles, by means of a piezoelectric or other type of actuator. As a result, black dots are formed on the printing surface of the conveyed roll paper R2.

The four cyan heads 25*a* of the cyan head unit 25 are likewise formed in a staggered pattern. A cyan nozzle row 25*b* that ejects droplets of cyan ink from the nozzles is formed to each of the cyan heads 25*a*.

The four magenta heads 26*a* of the magenta head unit 26 are likewise formed in a staggered pattern. A magenta nozzle row 26*b* that ejects droplets of magenta ink from the nozzles is formed to each of the magenta heads 26*a*.

The four yellow heads 27*a* of the yellow head unit 27 are likewise formed in a staggered pattern. A yellow nozzle row 27*b* that ejects droplets of yellow ink from the nozzles is formed to each of the yellow heads 27*a*.

Note that for convenience, each of the heads and the nozzle row in each head are shown in FIG. 3, but the heads are actually formed so that ink is ejected perpendicularly down from the nozzles in each nozzle row, and other members are also provided to achieve this configuration.

An inkjet printer 1 prints images as a combination of dots formed by ejecting ink onto the conveyed roll paper R2. the inkjet printer 1 conveys the conveyed roll paper R2 in the conveyance direction F as shown in FIG. 3. As conveyance of the conveyed roll paper R2 proceeds in the inkjet printer 1 and the print area where an image is to be formed on the conveyed roll paper R2 reaches the black nozzle row 24*b* located further upstream, black ink is ejected from the nozzles in the black nozzle row 24*b*. When the print area then reaches the cyan nozzle row 25*b*, cyan ink is ejected; magenta ink is ejected when the print area reaches the magenta nozzle row 26*b*; and yellow ink is ejected when the print area reaches the yellow nozzle row 27*b*. Four colors of ink are thus ejected to the conveyed roll paper R2, and a full-color image is printed in the print area.

FIG. 4 is a block diagram showing the functional configuration of the inkjet printer 1.

As shown in FIG. 4, the inkjet printer 1 is connected to communicate data with a host computer 5 (print control device), and the inkjet printer 1 and host computer 5 embody a printing system 2.

The printing system 2 is a system in which the host computer 5 outputs data to be printed in response to user operations, and the inkjet printer 1 prints on the print medium based on the data to be printed.

An application program for controlling the inkjet printer 1 and a printer driver program are installed on the host computer 5, and the host computer 5 sends commands to the inkjet printer 1 and controls the inkjet printer 1 by functions of these programs.

The host computer 5 has a host control unit 100 that controls parts of the host computer 5. The host control unit 100 has a CPU, ROM, RAM, and other peripheral circuits as the execution unit not shown. Firmware that can be run by the CPU, and data associated with the firmware, are stored in ROM in the host control unit 100. Data associated with the firmware run by the CPU is also temporarily stored in RAM. the host control unit 100 includes a application execution unit 101, printer driver execution unit 102 (input receiving unit, command control unit), and print monitor unit 103 (command transmission unit). These function units are rendered by the CPU running a program, for example.

The application execution unit 101 runs a text editor, an image editor, a POS application, a label editor, or other type of application. When a print command is issued by a user operation, the application execution unit 101 generates and outputs data for printing the document or image that was created.

The printer driver execution unit 102 executes a device driver program for controlling the inkjet printer 1. The printer driver execution unit 102 generates and outputs commands for controlling the inkjet printer 1 and data related to the commands to the inkjet printer 1, and controls operation of the inkjet printer 1. For example, the printer driver execution unit 102 generates and outputs a print instruction command instructing the inkjet printer 1 to print, and the data to be printed, such as image data or text data to print, based on the data output by the application execution unit 101. In addition to the print instruction command, the printer driver execution unit 102 can also generate and output control commands for controlling the inkjet printer 1 together with data related to the control commands.

Note that the device driver program the printer driver execution unit 102 runs is not limited to a program optimized for the inkjet printer 1, and may be a generic device driver program. It may also be a device driver program for a different model of printer. In this event, the inkjet printer 1 must be able to process commands and data the printer driver execution unit 102 outputs for the other model of printer.

The print monitor unit 103 (command transmission unit) runs a monitoring program that monitors the inkjet printer 1. The print monitor unit 103 detects the operating status of the inkjet printer 1, controls sending commands generated by the printer driver execution unit 102, and controls monitoring responses to commands sent to the inkjet printer 1.

More specifically, the print monitor unit 103 sequentially acquires and sends commands output by the printer driver execution unit 102 to the inkjet printer 1. When plural commands are sent to the inkjet printer 1, the print monitor unit 103 causes the inkjet printer 1 to execute the commands in a specific order, and adjusts the transmission sequence and the transmission timing of the commands. In this event, the print monitor unit 103 sends commands to the inkjet printer 1, for example, and after receiving a response to the command, controls sending the next command.

When the application execution unit 101 outputs a command, the print monitor unit 103 acquires the command and controls transmission in the same way as transmission of commands output by the printer driver execution unit 102.

When the print monitor unit 103 sends a command generated by the application execution unit 101 or printer driver execution unit 102 to the inkjet printer 1 and then receives a response from the inkjet printer 1, it returns the received response to the unit that generated the original command. The application execution unit 101 and printer driver execution unit 102 can therefore receive the response to the generated command. The format of the responses the print monitor unit 103 receives is not specifically limited. For example, the responses may in the form of response commands, the form of status reports, or other data format, and responses can be written as expresses including any of these forms.

The print monitor unit 103 generally executes a program module known as a language monitor (LM) or port monitor to apply the above control. The print monitor unit 103 may be a module that is part of the host computer 5 operating system or the printer driver execution unit 102.

The host computer 5 also has a host display unit 113 for displaying information, a host input unit 112 for detecting operation of the connected input devices, a host storage unit 111 for storing data, and a communication interface 110 connected to the inkjet printer 1. The host display unit 113 and host input unit 112 are provided for user operation. The host storage unit 111 nonvolatilely stores programs such as the control program, application program, or device driver run by the host control unit 100, and data related to these programs.

The inkjet printer 1 has a printer control unit 50 (control unit) that controls other parts of the inkjet printer 1. A communication interface 51 that connects to the host computer 5, and a printer storage unit 52, are connected to the printer control unit 50. The interface 51 connects to the host computer 5 by wire or wirelessly.

The printer control unit 50 includes a CPU as an operating unit, ROM and RAM. Firmware that can be executed by the CPU and data related to the firmware is nonvolatilely in the ROM of the printer control unit 50. Data related to the firmware run by the CPU is also temporarily stored in RAM.

The printer storage unit 52 has a storage medium such as EEPROM, flash memory, or other type of semiconductor memory, or a hard disk drive, and nonvolatilely stores data rewritably. The printer storage unit 52 stores programs that are executed by the printer control unit 50, data related to the control programs, and commands and data the inkjet printer 1 received from the host computer 5.

The printer storage unit 52 in this embodiment also stores the flushing settings data 52*a* relating to regular flushing and onto-paper flushing conditions described above, and reference flushing pattern 52*b* data used for onto-paper flushing.

An operation detection unit 55 that detects operation of operating switches 54 disposed to a switch panel (not shown in the figure) is connected to the printer control unit 50. The operating switches 54 includes, for example, a paper feed switch commanding the conveyance operation of the inkjet printer 1, a cut switch commanding operation of the cutter unit 37, and a configuration switch for making settings. A display unit such as an LCD panel or 7-segment display may be disposed to the switch panel. In this configuration, display of content by the display unit of the switch panel may be controlled by the operation detection unit 55.

A sensor drive unit 56 that gets the detection values of the paper detector 19 is also connected to the printer control unit 50.

The sensor drive unit 56 outputs the detection value of the paper detector 19 to the printer control unit 50. Based on the detection value of the paper detector 19, the printer control unit 50 then detects if the leading end or the trailing end of the conveyed roll paper R2 reached the detection position of the paper detector 19.

The sensor drive unit 56 also outputs the detection value of the black mark detector 20 to the printer control unit 50. Based on the detection value of the black mark detector 20, the printer control unit 50 detects if a black mark BM reached the detection position T1.

The sensor drive unit 56 also outputs the detection value of the temperature sensor 71 to the printer control unit 50. The temperature sensor 71 is a temperature sensor disposed to a specific position of the inkjet head 10, and detects the temperature of the inkjet head 10. Based on the detection value of the temperature sensor 71 the printer control unit 50 detects the temperature of the inkjet head 10.

Also connected to the printer control unit 50 are a conveyance motor 31, spindle rotation motor 64, cutter drive motor 65, carriage moving motor 66, and a motor driver 67 that drives the pump unit 69.

The conveyance motor 31 is a brushless DC motor, for example, and conveys the recording medium by moving the conveyor belt 30. The printer control unit 50 controls the motor driver 67 to supply drive current from the motor driver 67 to the conveyance motor 31, and drives the conveyance motor 31.

The spindle rotation motor 64 causes the paper roll R1 to turn by rotating the roll paper spindle 9 inserted to the core R3 of the paper roll R1. When the paper roll R1 turns in the direction shown as the conveyance direction F, the conveyed roll paper R2 is pulled from the paper roll R1. When the paper roll R1 turns in the opposite direction as the conveyance direction F, the conveyed roll paper R2 is pulled back to the paper roll R1.

The spindle rotation motor 64 is also a brushless DC motor. The printer control unit 50 controls the motor driver 67 to supply drive current from the motor driver 67 to the spindle rotation motor 64, and drives the spindle rotation motor 64.

The cutter drive motor 65 drives the movable knife of the cutter unit 37 to cut the recording medium. The carriage moving motor 66 moves the carriage 70 (inkjet head 10) between the printing position PP and the home position HP. The pump unit 69 has a diaphragm pump or an axial flow pump that reduces the pressure inside the cap of the maintenance unit 90.

A head driver 68 that drives the inkjet head 10 is connected to the printer control unit 50. The printer control unit 50 controls the head driver 68, supplies voltage to the pump (not shown in the figure) that supplies ink from the ink tank (not shown in the figure) to the inkjet head 10, and to the piezoelectric actuator (not shown in the figure) of each head of the inkjet head 10, and thereby operates the inkjet head 10. As a result, ink droplets are ejected from the nozzles of the heads and dots are formed.

While conveying the recording medium in conjunction with printing an image on the recording medium, the printer control unit 50 manages the position of the recording medium on the conveyance path HK based on the detection value output from the black mark detector 20 and the rotational angle of the conveyance motor 31. The printer control unit 50 detects the rotational angle of the conveyance motor 31 based on the output of a rotary encoder not shown disposed according to the conveyance motor 31.

The printer control unit 50 has as execution units that render functions: a command reception unit 50*a*, command interpreter 50*b*, configuration unit 50*c*, flushing control unit 50*d*, print control unit 50*e*, and image processing unit 50*f*. These execution units correspond to functions rendered by the CPU executing firmware.

A receive buffer 50*g* and print buffer 50*h*, which are temporary storage areas (buffer memory), are reserved in the storage area of RAM (not shown in the figure) of the printer control unit 50. Either or both the receive buffer 50*g* and print buffer 50*h* can be rendered in the printer storage unit 52 or in RAM externally connected to the printer control unit 50.

The command reception unit 50*a* receives commands and data sent from the inkjet printer 1 through the interface 51, and stores them in the receive buffer 50*g*. The commands and data received by the command reception unit 50*a* are accumulated in the receive buffer 50*g* in the order received.

The command interpreter 50*b* reads and interprets the commands and data stored in the receive buffer 50*g* sequentially according to the address in the receive buffer 50*g*. Because the commands and data are accumulated in the receive buffer 50*g* in the order received, the commands and data are interpreted by the command interpreter 50*b* in the order received. If the interpreted command or data is a command to be executed by the configuration unit 50*c* or data to be processed by the configuration unit 50*c*, the command interpreter 50*b* passes the command or data to the configuration unit 50*c*. For example, the command interpreter 50*b* passes a set level command for setting the level of onto-paper flushing to the configuration unit 50*c*, and the configuration unit 50*c* executes the command. In this event, the configuration unit 50*c* overwrites the data indicating the onto-paper flushing level stored in the flushing settings data 52*a*.

If the interpreted command or data is a command to be executed by the print control unit 50*e* or data to be processed by the print control unit 50*e*, the command interpreter 50*b* passes the command or data to the print control unit 50*e*. For example, the command interpreter 50*b* passes print instruction commands and data to be printed to the print control unit 50*e*. Likewise, if the interpreted command or data is a command to be executed by the image processing unit 50*f* or data to be processed by the image processing unit 50*f*, the command interpreter 50*b* passes the command or data to the image processing unit 50*f*.

The print control unit 50*e* prints based on the print data received from the host computer 5. The print control unit 50*e* acquires the image data and character data contained in the print data, and renders the image data to print in the print buffer 50*h* through the image processing unit 50*f*.

If image data is contained in the data to be printed, the image processing unit 50*f* renders the image data as rasterized image data in the print buffer 50*h*.

If character data is contained in the data to be printed, the image processing unit 50*f* reads the font data for the character data from the printer storage unit 52, generates image data for the characters, and renders the character image data as rasterized image data in the print buffer 50*h*. The character data contained in the data to be printed comprises, for example, data indicating the character codes and font of the characters, and by using the font data corresponding to the specified character codes of the specified font, can generate images for the characters to be printed by the inkjet head 10. The print buffer 50*h* is a storage area created according to the print resolution of the inkjet head 10 and the size of the printable area of the inkjet printer 1.

Based on a predefined lookup table (LUT) not shown stored in the printer storage unit 52, the print control unit 50*e* converts the data generated by the image processing unit 50*f* to data indicating the amount of ink to be ejected by each nozzle of the inkjet head 10. The image data rendered in the print buffer 50*h* is rasterized image data setting print color data for each pixel in a specific number of pixels covering the printable area of the inkjet printer 1. Based on the lookup table, the print control unit 50*e* converts the color information for each pixel in the image data rendered in the print buffer 50*h* to the amount of each color of ink to be ejected by the inkjet head 10. Based on the amount of ink of each color, the print control unit 50*e* generates ink volume data assigned to each nozzle of the black head unit 24, cyan head unit 25, magenta head unit 26 and yellow head unit 27. The print control unit 50*e* then drives the inkjet head 10 according to the generated ink volume data, and prints the image on the conveyed roll paper R2.

While the print control unit 50*e* is printing, the flushing control unit 50*d* controls onto-paper flushing and regular flushing. The flushing control unit 50*d* monitors driving the inkjet head 10 by the print control unit 50*e*, and measures the time that the inkjet head 10 is away from the home position HP. While the inkjet head 10 is away from the home position HP, the flushing control unit 50*d* executes regular flushing according to the preset flushing interval. In the event of regular flushing, the flushing control unit 50*d* pauses the printing operation of the print control unit 50*e* and moves the inkjet head 10 to the home position HP. The flushing control unit 50*d* then drives the inkjet head 10 to eject ink from the nozzles into the maintenance unit 90.

The flushing control unit 50*d* then moves the inkjet head 10 back to the printing position PP and resumes printing by the print control unit 50*e*. The flushing control unit 50*d* also operates the conveyance motor 31 in the indexing operation conveying and positioning the conveyed roll paper R2 to the start printing position. When regular flushing is performed, time is therefore required to move the inkjet head 10 and for the conveyance operation positioning the conveyed roll paper R2 to the start printing position.

The flushing control unit 50*d* also executes onto-paper flushing while printing with the print control unit 50*e*. In the event of onto-paper flushing, the flushing control unit 50*d* reads the flushing settings data 52*a* and gets the onto-paper flushing level. The flushing control unit 50*d* also gets the reference flushing pattern 52*b* corresponding to the set flushing level, and generates and outputs a flushing pattern based on the reference flushing pattern 52*b* to the print control unit 50*e*. The print control unit 50*e* merges the flushing pattern with the ink ejection volume data generated from the data in the print buffer 50*h*, and updates the ink ejection volume data for each nozzle. As a result, the data related to ejecting ink to print the image, and the data related to ejecting ink for onto-paper flushing, are combined. The print control unit 50*e* then drives the inkjet head 10 to eject ink based on the merged data. As a result, flushing occurs while printing the image.

Commands used in this printing system 2 are described next.

The command used in the printing system 2 according to this embodiment includes a prefix character, command identifier, and parameter.

The prefix character is, for example, a single-character ASCII code that identifies the type of command. The printing system 2 uses two types of commands, formatting commands and control commands. A formatting command is a command instructing the print format for printing by the inkjet printer 1, and a print instruction command. A control command is a command related to controlling the inkjet printer 1. The prefix character of a formatting command is a single-byte forward slash character (/), and the prefix character of a control command is a single-byte asterisk (*).

The command identifier indicates the type of command, and is a 1 to 3 character ASCII code, for example. The parameter is a value controlling a function of the command, and declares the value by an ASCII code of one or more characters. The parameter may use numbers, may use letters, or may use both numbers and letters depending upon the type of command. Numeric parameters have maximum and minimum limits corresponding to the type of command. If the parameter value exceeds the maximum limit, the command interpreter 50*b* uses the maximum as the declared value. If the parameter value is less than the minimum limit, the command interpreter 50*b* uses the minimum as the declared value. If the parameter is omitted, the command interpreter 50*b* uses a default value as the declared value. For example, in the event of the set level command setting the level for onto-paper flushing, the level is declared by the parameter, and if the parameter is omitted, the level is set to an initial value (default value).

Commands for setting the mode of onto-paper flushing in the printing system 2 include both a formatting command and a control commands. An example of the formatting command is shown in (1) below, and an example of a control command is shown in (2) below.

/FDMP (parameter) (1)

*HDMP (parameter) (2)

The formatting command has a predefined syntax, and includes a group of commands starting with a start label format code and ending with an end label format code. Plural commands including a prefix character, command identifier, and parameter can be written between the start code and the end code. The host computer 5 can send plural commands to the inkjet printer 1 using this syntax. In this event, the inkjet printer 1 can be controlled to execute plural processes by sending one group of commands from the host computer 5 to the inkjet printer 1.

For example, the group of commands (also called a command group) could include a print instruction command and a command sending the data to be printed in addition to the set level command for onto-paper flushing described above. In this event, the inkjet printer 1 both sets the level for onto-paper flushing and prints.

The order of the formatting commands in the command group between the start label format code and end label format code is not specifically limited, but the commands are preferably arranged in an execution sequence suited to the commands. When a formatting command is received, the command reception unit 50*a* stores the commands in the command group written between the start code and the end code to the receive buffer 50*g* in the order they are written in the command group. These commands are then interpreted by the command interpreter 50*b* in the order they are accumulated in the receive buffer 50*g*.

For example, if the set level command setting the onto-paper flushing level is first, and the commands related to printing instructions follow, the inkjet printer 1 will print after setting the onto-paper flushing level. More specifically, printer operations will be set by the commands contained in one command group, and printing will then follow according to the settings. The opposite is also true.

That is, if the commands related to the print instructions are listed first, and the set level command for the onto-paper flushing follows, the onto-paper flushing level will be set after printing is completed. The printing operation in this event will therefore not reflect the onto-paper flushing level set by the set level command. Some embodiments of the present invention therefore lists the commands related to the print instructions after the set level command for the onto-paper flushing in the command group.

The control commands do not have a defined syntax, and control commands are sent individually from the host computer 5 to the inkjet printer 1. To set the onto-paper flushing level, the command *HDMP (parameter) is sent individually from the host computer 5 to the inkjet printer 1. In this event, the command reception unit 50*a* stores one command in the receive buffer 50*g*, and the command interpreter 50*b* interprets and executes the one command. When the command interpreter 50*b* detects a *HDMP (parameter) command, it updates the flushing settings data 52*a* according to the value of the parameter in the command.

By thus using formatting commands in the printing system 2, the onto-paper flushing level can be set together with a print instruction command. The onto-paper flushing level can also be set at the desired time by a control command without restricting the timing for printing.

Figure 5:
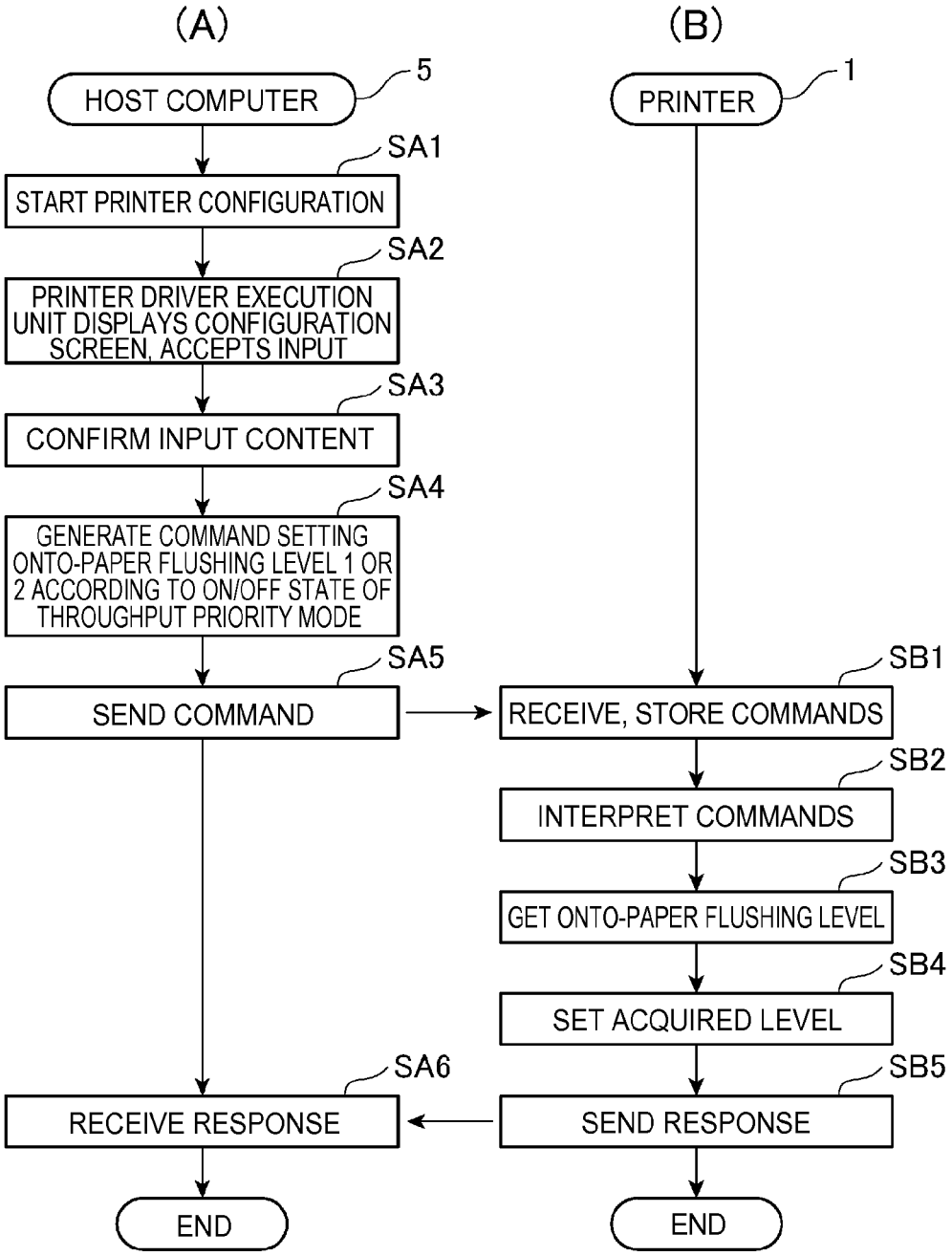
FIG. 5 is a flow chart illustrating the operation of the printing system.

FIG. 5 is a flowchart of the operation of setting the onto-paper flushing level by a command, (A) showing the operation of the host computer 5, and (B) showing the operation of the inkjet printer 1.

When printer configuration is started on the host computer 5 by the user operating an input device connected to the host input unit 112 (step SA1), a configuration screen is displayed and user input is accepted by a function of the printer driver execution unit 102 (step SA2). In this example, a screen for setting the onto-paper flushing level is displayed in step SA2.

Figure 6:
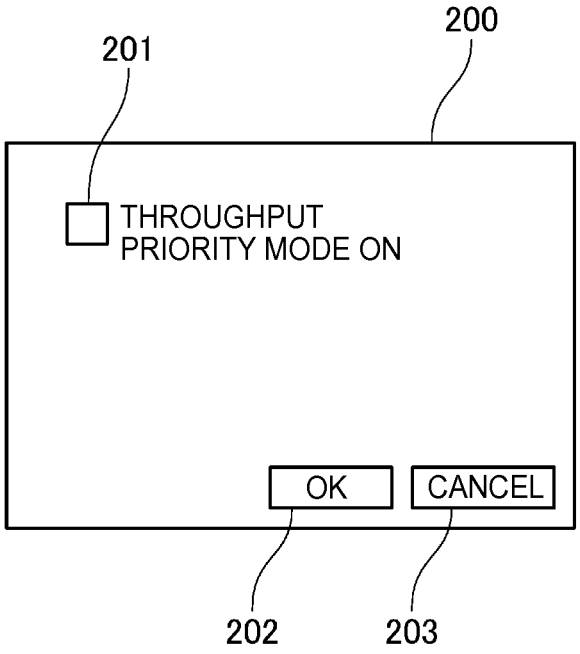
FIG. 6 shows an example of a user interface.

FIG. 6 shows an example of a configuration screen 200 displayed on the host display unit 113 by a function of the printer driver execution unit 102. The configuration screen 200 is a user interface enabling the user to set the onto-paper flushing level, and the printer driver execution unit 102 that displays the configuration screen 200 is an input reception unit.

In this example, the user interface shown in FIG. 6 does not show the onto-paper flushing level, and instead enables inputting whether to set the operating mode called a throughput priority mode in this embodiment on or off. The inkjet printer 1 in this example enables exclusively selecting one of two operating modes, a normal operating mode (first operating mode) and this throughput priority mode (second operating mode), as the operating mode for printing. One of these two operating modes can be selected by input to the configuration screen 200. In this example, the normal operating mode is selected when the throughput priority mode is off.

In the normal operating mode, the onto-paper flushing level is set to level 2. Because the ink ejection volume is low in level 2, the ink ejected by onto-paper flushing is not conspicuous in the printout on the conveyed roll paper R2. Because the change in print quality is therefore low, the operating mode is acceptable for the user.

The throughput priority mode, however, is an operating mode selected for high printer throughput. In the throughput priority mode, the onto-paper flushing level is set to level 1. Because the ink ejection volume of onto-paper flushing increases in this mode, the flushing interval is long, the frequency of regular flushing is low, and throughput is therefore improved. Because more ink is ejected by onto-paper flushing in the throughput priority mode, the ink deposited outside of the target image printed on the conveyed roll paper R2 is obvious and the drop in print quality may be apparent to the user, but is still acceptable for an operating mode that prioritizes throughput over print quality.

Understanding the effect that the ink ejection volume in onto-paper flushing has on print quality and the printing operation is not necessarily easy for non-technical users to understand. Therefore, even if a setting for the onto-paper flushing level is displayed in the configuration screen 200 so that the user can set the flushing level, it will not be easy for the user to master how to use the inkjet printer 1. However, the level of the ink ejection volume in onto-paper flushing can be easily set by enabling the user to select through a configuration screen 200 (user interface) whether to use the throughput priority mode or use the normal operating mode as shown in FIG. 6.

The configuration screen 200 has a check box 201 for selecting or cancelling the throughput priority mode, an OK button 202 for confirming the selection of the check box 201, and a cancel button 203 for cancelling changing the selection. If the check box 201 is checked and the OK button 202 is clicked, the throughput priority mode is turned on. If the check box 201 is cleared and the OK button 202 is clicked, the throughput priority mode is turned off, that is, the normal operating mode is turned on.

When the OK button 202 in the configuration screen 200 is operated, the printer driver execution unit 102 generates a set level command for onto-paper flushing according to the selection in the check box 201. This command is generated as a control command described above, for example.

Referring again to FIG. 5, when the content input through the user interface is confirmed by, for example, operating the OK button 202 (step SA3), the printer driver execution unit 102 generates a command corresponding to the on/off setting of the throughput priority mode (step SA4). The print monitor unit 103 then sends the command output by the printer driver execution unit 102 to the inkjet printer 1 (step SA5).

The command reception unit 50*a* then receives and stores the command the host computer 5 sent in the receive buffer 50*g* (step SB1). Next, the command interpreter 50*b* interprets the commands in the receive buffer 50*g* (step SB2), and if the command is determined to be a set level command setting the onto-paper flushing level, passes the command and parameter to the configuration unit 50*c*. Based on the parameter value in the command, the configuration unit 50*c* gets the level set by the command (step SB3). The configuration unit 50*c* then updates and sets the flushing settings data 52*a* based on the acquired level (step SB4).

After setting the flushing level, the printer control unit 50 sends a response command indicating that the process instructed by the command ended to the host computer 5 (step SB5). The print monitor unit 103 then receives the response sent from the inkjet printer 1 (step SA6). This response command is a response to the set level command generated by the printer driver execution unit 102. The print monitor unit 103 thus recognizes the response to the command from the printer driver execution unit 102, and may report to the printer driver execution unit 102 that the setting was successfully completed. The format of the responses generated by the printer control unit 50 is not specifically limited, and may in the form of a response command, the form of a status report, or other data format.

Through the operation described in FIG. 5, the configuration unit 50*c* updates the flushing settings data 52*a*, and sets the level for onto-paper flushing to level 1 or level 2. The time until the next regular flushing is also set in the flushing settings data 52*a*. When onto-paper flushing is set to level 1, the ink inside the nozzles is frequently replaced. As a result, increased viscosity can be prevented even if the frequency of regular flushing is low. However, if onto-paper flushing is set to level 2, regular flushing must be performed at the regular frequency. The flushing interval of regular flushing is therefore also set relationally to the onto-paper flushing level in the flushing settings data 52*a*. As a result, when the onto-paper flushing level is set, the flushing interval corresponding to the set level is retrieved and used.

The printer driver execution unit 102 may therefore generate a command setting the onto-paper flushing level and a command setting the flushing interval. More specifically, when the throughput priority mode is turned on through the configuration screen 200, the printer driver execution unit 102 may generate a command setting the onto-paper flushing level to level 1, and a command setting the flushing interval to a shorter time than the standard interval. When the throughput priority mode is turned of f through the configuration screen 200, the printer driver execution unit 102 may generate a command setting the onto-paper flushing level to level 2, and a command setting the flushing interval to the standard interval. In this event, there is no need to relationally set the onto-paper flushing level and the flushing interval in the flushing settings data 52*a*, and changing the flushing interval can be controlled by the host computer 5.

When the throughput priority mode is set using the configuration screen 200, the setting can be displayed and confirmed on the host display unit 113 of the host computer 5. The current throughput priority mode setting may also be displayed in the display unit of the switch panel on the inkjet printer 1. This display may also change according to operation of the operating switch 54. Alternatively, when the configuration unit 50*c* sets the level specified by command according to the set level command for onto-paper flushing, the throughput priority mode corresponding to the set level may be displayed in the display unit.

Figure 7:
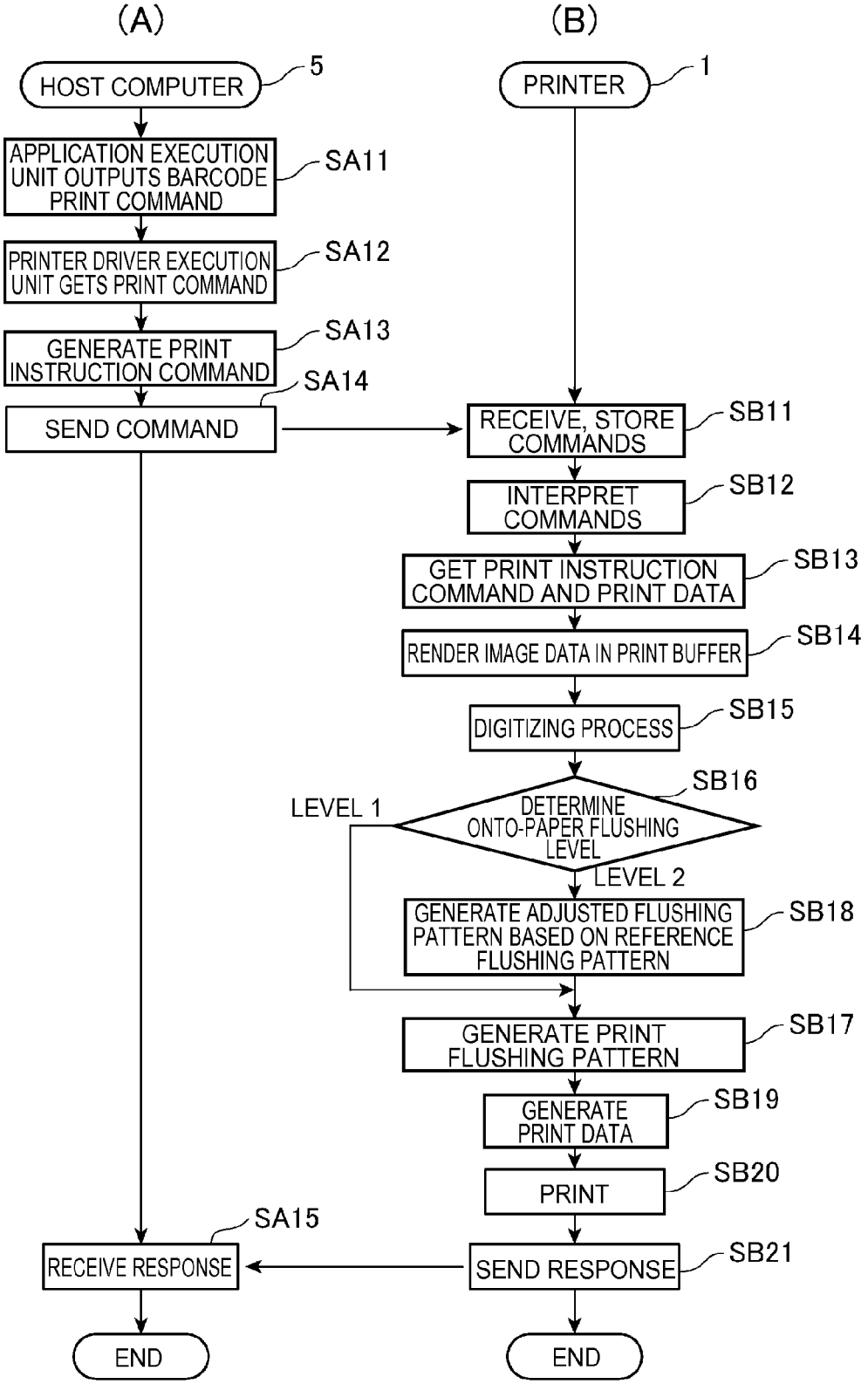
FIG. 7 is a flow chart illustrating the operation of the printing system.

FIG. 7 is a flow chart of the operation of the printing system 2 related to printing, (A) showing the operation of the host computer 5, and (B) showing the operation of the inkjet printer 1.

In this example, the application execution unit 101 of the host computer 5 generates and outputs data to be printed and print instructions to the printer driver execution unit 102 (step SA11). The data generated by the application execution unit 101 may include character codes for a string, a barcode code, or image data.

The printer driver execution unit 102 then acquires the data and print instructions input from the application execution unit 101 (step SA12), and generates a print instruction command or group of commands (step SA13). The printer driver execution unit 102 outputs the command or command group generated in step SA13 to the print monitor unit 103, and the print monitor unit 103 passes them to the inkjet printer 1 (step SA14).

The command reception unit 50*a* receives and stores the commands the host computer 5 sent in the receive buffer 50*g* (step SB11). If the commands sent by the host computer 5 are a command group including plural formatting commands, the command reception unit 50*a* sequentially stores the plural commands in the command group in the receive buffer 50*g*. The command interpreter 50*b* then sequentially interprets the commands in the receive buffer 50*g* (step SB12), and passes the print instruction commands and data to be printed to the print control unit 50*e*. The print control unit 50*e* then gets the print instruction commands and data to be printed (step SB13), and calls the image processing unit 50*f*. The image processing unit 50*f* then renders the data to be printed and stores the image data to print in the print buffer 50*h* (step SB14).

The print control unit 50*e* then converts the color data (such as gray scale RGB data) for each pixel in the image data the image processing unit 50*f* rendered in the print buffer 50*h* to CMYK ink volume data based on a LUT stored in the printer storage unit 52. Following this color conversion process, the print control unit 50*e* executes a digitizing process converting the ink volume data for the pixels to dot data that can be formed by the nozzles of each color of the inkjet head 10 (step SB15). The nozzles of the inkjet head 10 can form four types of dots: white, small, medium and large (more specifically, no dot and three sizes of dots). The dot data for each nozzle is converted to four-level data including white (no dot).

The flushing control unit 50*d* references the flushing settings data 52*a* and determines the onto-paper flushing level (step SB16). If set to level 1, the flushing control unit 50*d* generates a print flushing pattern using the reference flushing pattern 52*b* (step SB17).

The reference flushing pattern 52*b* is a pattern for selecting the nozzles of the inkjet head 10 that are to eject ink, and may be a dot matrix pattern of n columns by m rows (where n and m are integers), for example. This dot matrix pattern is composed of white dots and flushing dots. A flushing dot represents a nozzle that ejects ink, and a white dot represents a nozzle that does not eject ink. The flushing control unit 50*d* applies the n-by-m reference flushing pattern 52*b* color by color to the nozzles of the black head 24*a*, cyan head 25*a*, magenta head 26*a*, and yellow head 27*a*.

For example, if the head of a particular color comprises p columns by q rows (where p and q are integers) of nozzle rows, the n-by-m reference flushing pattern 52*b* is scaled to p columns by q rows. This can be done by, for example, scaling the reference flushing pattern 52*b* vertically to p/n, and horizontally to q/m, discarding the remainders. This can also be done by aligning multiple reference flushing patterns 52*b*, and extracting a p-by-q pattern therefrom.

After the reference flushing pattern 52*b* is scaled to the rows of nozzles, the flushing control unit 50*d* selects the nozzles that are also flushing dots, and selects those nozzles to eject ink. As a result of this process, the nozzles for ejecting ink in onto-paper flushing can be selected from among the numerous nozzles of the heads. The flushing control unit 50*d* generates a print flushing pattern indicating whether or not a particular nozzle ejects ink for all nozzles of the black head 24*a*, cyan head 25*a*, magenta head 26*a*, and yellow head 27*a*.

The ink ejection volume set by the print flushing pattern could be constant, for example. In the above example, when the ink ejection volume of the nozzles of the inkjet head 10 can be set to four levels, the print flushing pattern includes data for white dots and small, medium, and large dots. The amount of ink ejected in onto-paper flushing is preferably the smallest amount that can replace the ink inside the nozzle, and dots that are small, medium, or large are therefore selected.

However, if onto-paper flushing is set to level 2, the flushing control unit 50*d* generates an adjusted flushing pattern based on the reference flushing pattern 52*b* (step SB18). This adjusted flushing pattern has fewer flushing dots than the reference flushing pattern 52*b*. More specifically, the flushing control unit 50*d* generates the adjusted flushing pattern by a process that increases the ratio of white dots to flushing dots by, for example, inserting a specific number of white dots between the flushing dots of the reference flushing pattern 52*b*.

The adjusted flushing pattern is a dot matrix pattern like the reference flushing pattern 52*b*, but the number of rows and/or columns may be the same or different from the reference flushing pattern 52*b*. The flushing control unit 50*d* then generates a print flushing pattern using the adjusted flushing pattern that was generated (step SB17). More specifically, the flushing control unit 50*d* renders an adjusted flushing pattern according to the arrangement of nozzles in the inkjet head 10, and selects the nozzles at the same locations as the flushing dots as the nozzles to eject ink. The method of rendering this adjusted flushing pattern is the same as the method for rendering the reference flushing pattern 52*b*. The flushing control unit 50*d* generates a print flushing pattern indicating whether or not a particular nozzle ejects ink for all nozzles of the black head 24*a*, cyan head 25*a*, magenta head 26*a*, and yellow head 27*a*.

The print control unit 50*e* then generates the print data by overlaying the print flushing pattern generated in step SB17 to the dot data generated by the digitizing process of step SB15 (step SB19). This print data is data for the ink ejection volume (in four levels including white dots, for example) of each nozzle in the inkjet head 10, and includes dots for printing the image to be printed, and dots for onto-paper flushing. The print control unit 50*e* generates the print data by calculating the logical OR of the dot data and the print flushing pattern for each nozzle. The print data is therefore ink ejection data that forms more dots than the print flushing pattern and onto-paper flushing.

If a large dot, medium dot, or small dot in the dot data overlaps a dot of the print flushing pattern for any nozzle, the print control unit 50*e* determines the ink ejection volume and generates the print data for the nozzle using the data with the greater ink ejection volume. As a result, onto-paper flushing can be prevented from changing the print quality of the image to be printed.

In step SB19, the print control unit 50*e* also ignores dots in the print flushing pattern and sets the ink ejection volume of the nozzle to zero for any nozzle outside the target printing area of the conveyed roll paper R2. More specifically, ink is ejected in onto-paper flushing only in the target area specified as the area for printing an image on the conveyed roll paper R2. As a result, because ink ejected for onto-paper flushing does not land in areas of the conveyed roll paper R2 that are intended to be blank, the effect of onto-paper flushing on print quality can be suppressed. Furthermore, the liner may be exposed on the printing side when the conveyed roll paper R2 is label paper. If, as in this case, there are parts (such as the liner) to which ink will not adhere on the printed side, ink landing outside the targeted printing area can result in the printout being soiled after printing is completed. At least one embodiment of the present invention prevents such soiling because ink is not ejected outside the targeted printing area.

The print control unit 50*e* then drives the inkjet head 10 and conveyance motor 31 according to print data and prints (step SB20).

After printing is completed, the printer control unit 50 sends a response command indicating that printing ended to the host computer 5 (step SB21). The print monitor unit 103 receives the response command sent from the inkjet printer 1 (step SA15). This response command is a response to the print instructions command generated by the printer driver execution unit 102. The print monitor unit 103 may also report to the printer driver execution unit 102 that printing was completed.

During the operation described in FIG. 7, the flushing control unit 50*d* executes regular flushing according to the flushing interval set in the flushing settings data 52*a*. The interval for regular flushing is determined according to the onto-paper flushing level, and is longer in the throughput priority mode than in the normal operating mode. As a result, the frequency of regular flushing can be reduced and throughput improved.

As described above, the printing system 2 according to this embodiment has a inkjet printer 1 and a host computer 5. The inkjet printer 1 includes an inkjet head 10 with nozzles, and a conveyance unit 32 for conveying roll paper R2.

The printer control unit 50 executes regular flushing (first flushing) ejecting ink from the ink nozzles of the inkjet head 10 into the maintenance unit 90. The printer control unit 50 also performs onto-paper flushing (second flushing) ejecting ink from the ink nozzles of the inkjet head 10 onto the conveyed roll paper R2. The host computer 5 provides a user interface for selecting a normal operating mode (first operating mode) or throughput priority mode (second operating mode) by the printer driver execution unit 102. When the throughput priority mode is selected using the user interface, the printer driver execution unit 102 generates a command setting the conditions for flushing by the inkjet printer 1. This command is then sent to the inkjet printer 1 by the print monitor unit 103.

The printer control unit 50 of the inkjet printer 1 receives and interprets the commands sent by the host computer 5, and sets the conditions for executing onto-paper flushing according to the received command. As a result, when the user determines and inputs whether or not to prioritize printing throughput, the conditions for flushing on the conveyance path HK of the conveyed roll paper R2 are set according to the user input. The user can therefore easily and appropriately configure the flushing operation without having specific knowledge about the effect of flushing and conditions for flushing.

The printer control unit 50 can execute onto-paper flushing with the ink ejection volume set to any of plural different levels. When the throughput priority mode is selected through the user interface, the printer driver execution unit 102 generates a command setting the conditions for onto-paper flushing. As a result, whether or not the ink eject ion volume is increased when flushing is done on the conveyance path HK of the conveyed roll paper R2 can be set easily and appropriately.

When the normal operating mode is set using the user interface, the printer driver execution unit 102 generates a set level command specifying level 2 (second execution condition), which is the default. As a result, whether or not the ink ejection volume is increased when flushing is done on the conveyance path HK of the conveyed roll paper R2 can be set easily and appropriately.

After onto-paper flushing, the printer control unit 50 executes regular flushing according to the flushing interval, which is a preset period of time, and the flushing interval used when the onto-paper flushing level is level 1 (first execution condition) is longer than the flushing interval for level 2. Throughput can therefore be improved.

Regular flushing is flushing that ejects ink from the ink nozzles after moving the inkjet head 10 to the maintenance unit 90. Onto-paper flushing is flushing that ejects ink from the ink nozzles of the inkjet head 10 onto the conveyed roll paper R2 while the inkjet head 10 remains on the conveyance path of the conveyed roll paper R2. Thus comprised, the user can easily and appropriately set the conditions for onto-paper flushing by simply selecting either the normal operating mode or the throughput priority mode.

The present invention is described above with reference to some embodiments thereof, but the present invention is not limited thereto and can be modified and adapted in many ways without departing from the scope of the accompanying claims.

For example, because the ink ejection volume during onto-paper flushing differs according to the level that is set for flushing, the foregoing embodiment is described as selectively using the reference flushing pattern 52*b* and an adjusted flushing pattern created from the reference flushing pattern 52*b*. More specifically, the reference flushing pattern 52*b* is used at onto-paper flushing level 1, and the adjusted flushing pattern is used at level 2. The present invention is not so limited, however, and the adjusted flushing pattern may be previously stored in the printer storage unit 52. This configuration eliminates the need for a process to generate the adjusted flushing pattern, and reduces the processor load.

The ink ejection volume for onto-paper flushing can also be set in plural levels. In this event, the flushing dots of the reference flushing pattern 52*b* and adjusted flushing pattern may be configured using hierarchical ink ejection volume data. The adjusted flushing pattern can also be created as data with different ink ejection volumes for flushing dots at the same position in the reference flushing pattern 52*b*. This configuration simplifies the process of creating and rendering the adjusted flushing pattern.

When there are three or more levels for onto-paper flushing, plural adjusted flushing patterns may be created, or adjusted flushing patterns for each level may be stored in the printer storage unit 52 as described above.

The operating modes for printing in the inkjet printer 1 are also not limited to a throughput priority mode and normal operating mode, and a configuration that enables selecting one operating mode from more operating modes in the configuration screen 200 is conceivable. The configuration screen 200 may also be a user interface enabling selecting more settings than just turning the throughput priority mode on or off. In this event, the printer driver execution unit 102 may generate a command group containing commands related to multiple settings configured through the configuration screen 200.

The function blocks shown in FIG. 4 can be achieved by the cooperation of hardware and software, and do not suggest a specific hardware configuration. Functions of the host computer 5 and inkjet printer 1 could also be rendered by other devices externally connected thereto. The host computer 5 and inkjet printer 1 can also operate as described above by running programs stored on an externally connected storage medium. The present invention can also be applied to a multifunction device incorporating a print unit identical to the inkjet printer 1.

The disclosure being thus described, it will be apparent that it may be varied in many ways. Such variations are not to be regarded as a departure from the spirit and scope of the disclosure, and all such modifications as would be apparent to one skilled in the art are intended to be included within the scope of the following claims.

What is claimed is:

1. A printing system comprising:

a printing device including:

a printhead with ink nozzles, a conveyer that conveys a print medium, and a printer controller that executes a first flushing ejecting ink from ink nozzles of the printhead into an ink receiving part of the printing device temporarily interrupting a current printing operation, and a second flushing ejecting ink from ink nozzles of the printhead onto the print medium during the current printing operation; and a print control device external to the printing device, including:

a user interface indicating a printer throughput prioritizing choice to select between a first printing mode or a second printing mode, the second printing mode prioritizing printer throughput more than the first printing mode;

a command controller that generates commands including a flush-condition command specifying a flushing routine for the printing device in accordance with the first printing mode or second printing mode selected through the user interface; and a command transmitter that transmits commands including the flush-condition command generated by the command controller;

wherein the printer controller receives and interprets commands transmitted by the print control device, and sets a flushing routine according to a received flush-condition command.

2. The printing system described in claim 1, wherein:

the printer controller selectively executes the second flushing according to plural ink-volume settings, each ink-volume setting specifying a different ink ejection volume to be flushed during the execution of the second flushing;

a first ink-volume setting among the plural ink-volume settings specifying a first ink ejection volume and being associated with the second printing mode; and the command controller of the print control device generates a command setting the first ink-volume setting for the second flushing when the second printing mode is selected using the user interface.

3. The printing system described in claim 2, wherein:

the command controller generates a command setting a second ink-volume setting specifying a second ink ejection volume, lower than the first ink ejection volume, for the second flushing when the first printing mode is selected using the user interface.

4. The printing system described in claim 1, wherein:

the printer controller selectively executes the first flushing at one of plural time-interval settings during the current printing operation, each time-interval setting specifying a different regular time interval at which to repeat execution of the first flushing during the current printing operation;

a first time-interval setting among the plural time-interval settings specifying a first time interval and being associated with the second printing mode;

the command controller of the print control device generates a command setting the first time-interval setting for the first flushing when the second printing mode is selected using the user interface; and the command controller generates a command setting a second time-interval setting specifying a second time interval, shorter than the first time interval, for the first flushing when the first printing mode is selected using the user interface.

5. The printing system described in claim 1, wherein:

the first flushing is a flushing operation that moves the printhead to the position of the ink receiving part, and ejects ink from ink nozzles of the printhead into the ink receiving part; and the second flushing is a flushing operation that ejects ink from the ink nozzles of the printhead onto the print medium while the printhead is on the conveyance path of the print medium.

6. A print control device that controls a flushing operation and a printing operation of a printer, comprising:

a user interface indicating a printer throughout prioritizing choice and accepting selection of a first printing mode or a second printing mode, the second printing mode prioritizing throughput of the printing operation more than the first printing mode;

a command controller that generates commands including flush-control commands controlling execution of a first flushing and a second flushing of the printer in accordance with the first printing mode or second printing mode selected through the user interface; and a command transmitter that transmits commands including the flush-control commands generated by the command controller;

wherein the printer is remote from the print control device, and the command transmitter transmits the commands to the printer; and wherein execution of the first flushing temporarily interrupts a current printing operation of the printer to eject ink from ink nozzles of a printhead of the printer into an ink receiving part of the printer, and execution of the second flushing ejects ink from ink nozzles of the printhead onto a print medium during the current printing operation.

7. The print control device described in claim 6, wherein:

the command controller generates a command setting a first ink-volume condition specifying a first total ink ejection volume to be ejected during the second flushing when the second printing mode is set using the user interface.

8. The print control device described in claim 7, wherein:

the command controller generates a command setting a second ink-volume condition specifying a second total ink ejection volume, lower than the first ink ejecting volume, to be ejected during the second flushing when the first printing mode is set using the user interface.

9. The print control device described in claim 6, wherein:

the command controller generates a command setting a time-interval specifying a fixed time interval at which to repeat execution of the first flushing during the current printing operation;

the time interval set for the first printing mode being shorter than the time interval set for the second printing mode.

10. The print control device described in claim 6, wherein:

the command controller assigns an ink volume to the second flushing according to the selected print mode, each assigned ink volume specifying a different total ink injection by volume to be flushed during the execution of the second flushing, print modes having higher printer throughput priority being assigned higher ink volumes; and the command controller assigns a time interval to the first flushing according to the selected print mode, each assigned time interval specifying a different fixed time interval at which to repeat execution of the first flushing during the current printing operation, the print modes having higher throughput priority being assigned longer time intervals.

11. A print control method for controlling a flushing operation and a printing operation of a remote printer, comprising:

providing a user interface remote from the printer indicating a printer throughput prioritizing choice and accepting selection of a first printing mode or a second printing mode, the second operating mode prioritizing throughput of the printing operation more than the first printing mode;

generating flush-control commands controlling execution of a first flushing and a second flushing of the printer in accordance with the first printing mode or second printing mode selected through the user interface; and transmitting the generated flush-control commands to the remote printer;

wherein execution of the first flushing temporarily interrupts a current printing operation of the printer to eject ink from ink nozzles of a printhead of the printer into an ink receiving part of the printer, and execution of the second flushing ejects ink from ink nozzles of the printhead onto a print medium during the current printing operation.

12. The print control method described in claim 11, further comprising:

generating a command setting a first ink-volume condition specifying a first total ink ejection volume to be ejected during the second flushing when the second printing mode is set using the user interface.

13. The print control method described in claim 12, further comprising:

generating a command setting a second ink-volume condition specifying a second total ink ejection volume to be ejected during the second flushing when the first printing mode is set using the user interface.

14. The print control method described in claim 11, further comprising:

generating a command setting a time-interval specifying a fixed time interval at which to repeat execution of the first flushing during the current printing operation;

the time interval set for the first printing mode being shorter than the time interval set for the second printing mode.

15. The print control method described in claim 11, further comprising:

assigning an ink volume to the second flushing according to the selected print mode, each assigned ink volume specifying a different total ink injection by volume to be flushed during the execution of the second flushing, print modes having higher printer throughput priority being assigned higher ink volumes; and assigning a time interval to the first flushing according to the selected print mode, each assigned time interval specifying a different fixed time interval at which to repeat execution of the first flushing during the current printing operation, the print modes having higher throughout priority being assigned longer time intervals.

16. The printing system described in claim 1, wherein the user interface lacks flush mode information.

17. The print control device described in claim 6, wherein the user interface lacks flush mode information.

18. The print control method described in claim 11, wherein the user interface lacks flush mode information.

19. The print control device described in claim 6, wherein the first flushing and second flushing are applied to the same ink nozzle during the current printing operation.

20. The print control method described in claim 11, wherein the first flushing and second flushing are applied to the same ink nozzle during the current printing operation.

* * * * *